United States Patent [19]

Hassall et al.

[11] 4,052,049

[45] Oct. 4, 1977

[54] CARD INJECTING APPARATUS

[75] Inventors: Stephen J. T. Hassall, Churchville; Neil S. White, Rochester, both of N.Y.

[73] Assignee: Eastman Kodak Company, Rochester, N.Y.

[21] Appl. No.: 634,203

[22] Filed: Nov. 21, 1975

Related U.S. Application Data

[63] Continuation of Ser. No. 506,917, Sept. 17, 1974, abandoned.

[51] Int. Cl.[2] ..... B65H 39/02

[52] U.S. Cl. ..... 270/58

[58] Field of Search ..... 270/58, 82, 85; 33/93 D, 93 DP; 271/8 R, 63, 211, 212; 214/6 BA; 302/4, 9, 10

[56] References Cited

U.S. PATENT DOCUMENTS

| | | | |
|---|---|---|---|
| 3,437,335 | 4/1969 | Gluskin | 271/8 R |
| 3,685,671 | 8/1972 | Layman | 214/6 BA |

*Primary Examiner*—Edgar S. Burr
*Assistant Examiner*—A. Heinz
*Attorney, Agent, or Firm*—S. W. Gremban

[57] ABSTRACT

A card injecting apparatus in which an air gun directs a jet of air underneath a stack of articles for lifting the articles above a supporting surface to form a space between the lowermost article and supporting surface. Additional jets of air are directed by the air gun for injecting a card into the space. The air gun is formed of two portions, one portion defined by a stationary member and the other portion defined by a slider member which is movable relative to the stationary member between two positions for successively feeding cards from spaced apart hoppers to the air gun.

3 Claims, 8 Drawing Figures

CARD INJECTING APPARATUS

This is a continuation of application Ser. No. 506,917 filed Sept. 17, 1974, now abandoned.

BACKGROUND OF THE INVENTION

1. Field of the Invention

This invention relates generally to sheet feeding apparatus, and more specifically to a card injecting apparatus for inserting a card underneath a stack of flat articles.

2. Description of the Prior Art

It is generally well known in the art to provide apparatus for inserting marking strips or cards into a forming stack of flat articles. Exemplary patents illustrating such apparatus are U.S. Pat. Nos. 3,095,193, 3,205,739 and 3,458,186. In such apparatus, a separating device is moved over the upper article of a stack for separating the stack from the articles accumulating on the upper surface of the separating device. While so separated, a marking strip is fed between the upper article in the stack and the separating device. When the separating device is retracted, the articles that had accumulated on the separating device are added to the stack above the marking strip. Although such separating devices operate successfully for inserting marking strips into a forming stack of articles, it is highly unlikely that such devices could be used successfully for inserting a strip or card beneath a previously formed stack of articles without binding on the lowermost article. Another disadvantage of such prior known strip inserting apparatus is that the use of a reciprocally movable separating device is required, and such device during its reciprocal movement engages and marks adjacent articles which must then be removed and discarded. In addition, the operation of the reciprocally movable separating device misaligns the upper and lower stack of articles which must then be rearranged in proper alignment. It is also known in the prior art to inject air between the separating device and the adjacent article of a stack for separating the two to permit easy insertion and withdrawal of the separating device. However, the compressed air does not completely eliminate all contact between the separating device and adjacent articles, and the resultant friction makes it difficult to insert the retract the separating device. Still another disadvantage of such prior art strip inserting apparatus is that the apparatus contains a considerable number of moving parts, is of relatively complicated construction and hence relatively costly to manufacture.

SUMMARY OF THE INVENTION

In accordance with a preferred embodiment of the invention, a card inserting apparatus is disclosed for inserting a card under a formed stack of flat articles. A card holding means is provided adjacent the stack and defines a recess having an open end facing the stack for receiving a card substantially in the same plane as the lowermost article in the stack. The card holding means is further provided with air jets having ends thereof terminating at the recess. The air jets are arranged at an angle to the recess for directing air toward the open end of the recess. One of the air jets is interposed between the leading end of the card and the stack for raising or lifting the stack when air under pressure is supplied thereto. One or more air jets is directed at an angle against the card for impelling the card forwardly and inserting it under the stack. The card is preferably formed from a stiff material such as cardboard.

More specifically, in this embodiment of the invention the air jets are disposed on opposite sides of the card holding recess. Also, the card holding means comprises a stationary member, and a movable member slidably supported by the stationary member. The movable member has a pair of spaced apart recesses for receiving cards, and is movable between a first position in which a first recess is in alignment with a stack and a second recess is in position to be loaded with a card, and a second position in which the second recess is in alignment with the stack and the first recess is in position to be loaded. One group of air jets are defined by the stationary member in alignment with the stack, and a pair of spaced second groups of air jets are defined by the movable member in register with the first and second recesses. The stationary and movable members further define ports for selectively interconnecting the first group of air jets to one of the second groups of air jets and to an air supplying means in each of the first and second positions of the movable member. A pair of spaced hoppers is provided for receiving cards. The hoppers are arranged so that in the first position of the movable member the first recess is below and in register with one of the hoppers for receiving a card, and the second recess is in alignment with the stack. In the second position of the movable member, the second recess is below and in register with the other hopper for receiving a card and the first recess is in alignment with the stack. The hoppers are removable from the apparatus and are provided with a clamp for releasably holding the cards in the hopper when the hopper is retracted.

Accordingly, one of the objects and advantages of the present invention is to provide a card injecting apparatus that eliminates the necessity of a reciprocally movable separating device for separating a stack of cards from the supporting surface.

Another object and advantage of the present invention is to provide a card injecting apparatus in which the stack of articles is raised above a supporting surface to form a space into which the card can be inserted without rubbing or marring the lowermost article.

Another object and advantage of the invention is to provide an improved card injecting apparatus that is of simple design and construction, thoroughly reliable and efficient in operation, and economical to manufacture.

The invention and its objects and advantages will become more apparent from the detailed description of the preferred embodiment presented below:

BRIEF DESCRIPTION OF THE DRAWING

In the detailed description of the preferred embodiment of the invention presented below, reference is made to the accompanying drawings, in which.

DESCRIPTION OF THE PREFERRED EMBODIMENT

Figure 1:
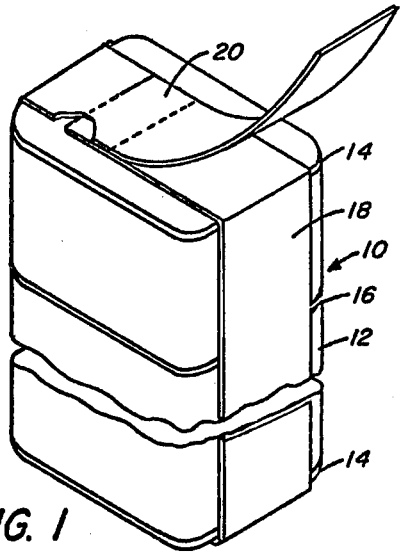
FIG. 1 is a perspective view illustrating a bundle of stacked articles having cards at each end and one interposed therebetween.
Figure 3:
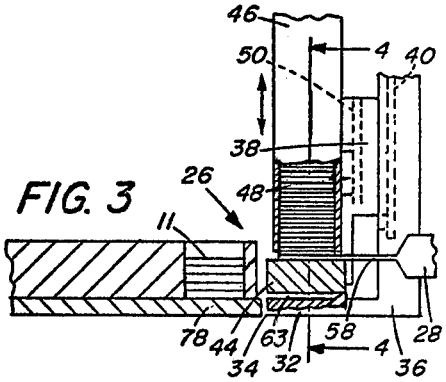
FIG. 3 is a section view taken substantially along line 3—3 of FIG. 2.

With reference to FIG. 1 of the drawing, a bundle 10 of stacked articles such as dental X-ray packets is illustrated of a type commercially supplied to users of dental packets. The bundle 10 comprises a stack 11 (FIG. 3) of dental packets 12 having end cards 14 at each end and a printed card 16 inserted near one end containing customer reorder information or the like. A banding tape 18 of Mylar (trademark) or the like is wrapped around the stack, and overlapped end portions thereof sealed at 20 to complete the bundle.

Figure 2:
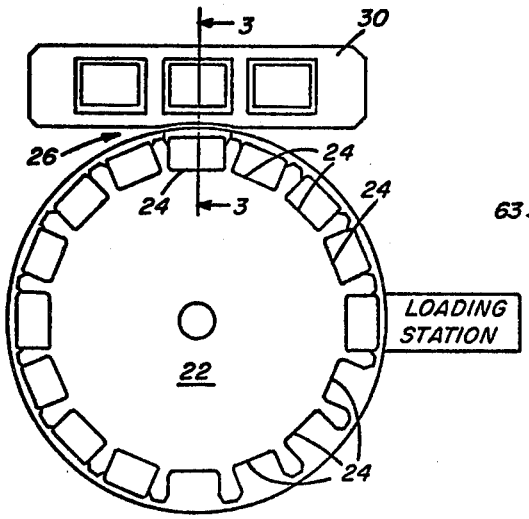
FIG. 2 is a top plan view of the card inserting apparatus of this invention for inserting cards on the top and bottom of one or more stacks of articles.

With reference to FIG. 2, apparatus for compiling a stack of dental packets 12 is illustrated comprising a rotatable carousel tray 22 containing peripheral pockets 24, and a loading station at which a stack 11 of a predetermined number of packets is inserted into each pocket. The tray 22 is indexed a step at a time by any suitable indexing mechanism for positioning each pocket 24 at the loading station. The apparatus further has a card injecting station 26 at which a preferred embodiment of the card injecting apparatus 30 of this invention is located for inserting a card under one or more of the stacks 11. A pusher mechanism 28 (FIG. 3) is also located at the card inserting station for pushing a card on top of one or more of the stacks 11. Upon further rotation of carousel tray 22, at least one stack 11 having a card 14 at each end thereof, and one having a card 16 at the bottom thereof are combined with other stacks to form an accumulated stack of packets which are subsequently banded to form bundle 10. The apparatus for combining the stacks 11 of packets 12 and bundling them do not form a part of this invention, and hence are not described in further detail.

Figure 4:
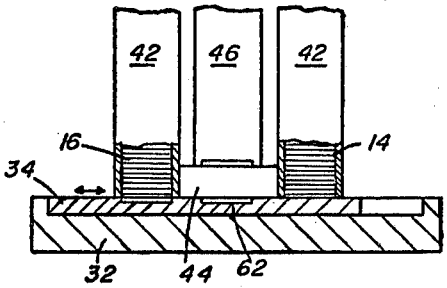
FIG. 4 is a section view taken substantially along line 4—4 of FIG. 3.

With reference to FIGS. 3–7, a preferred embodiment of the card injecting apparatus 30 of this invention is disclosed comprising a stationary base 32 and a slider member 34 slidably mounted on the base for reciprocal movement between two positions as indicated by the arrows in FIG. 4. The base 32 is secured by any suitable means to a stationary bracket 36 (FIG. 3) and a carriage 38 has rails slidably mounted in grooves 40 on bracket 36 for movement between operative and retracted positions as indicated by arrows in FIG. 3. A pair of spaced hoppers 42 are secured to carriage 38, one containing a supply of end cards 14 and the other containing a supply of printed cards 16. A block 44 is interposed between hoppers 42 and secured to carriage 38. A hopper 46 containing a supply of end cards 14 rests on block 44 and is secured to a plate 48 having rails slidably mounted in grooves 50 on carriage 38. The hopper 46 is movable between an extended position, in which the open end thereof is in register with a recess 52 (FIG. 5) in block 44, and a retracted position clear of the recess and block. The block 44 contains a conduit 54 (FIG. 5) connected to a source of vacuum and having air holes 56 connected to recess 52. Accordingly, during operation, the lowermost card 14 in hopper 46 drops by virtue of gravity into recess 52 and is held therein by the vacuum. Accordingly, when pusher mechanism 28 (FIG. 3) of any suitable type is operated, the vacuum holds the lowermost card flat in recess 52 as arm 58 strips the card from hopper 46 and feeds it on top of a stack 11 of packets in a pocket 24.

Figure 7:
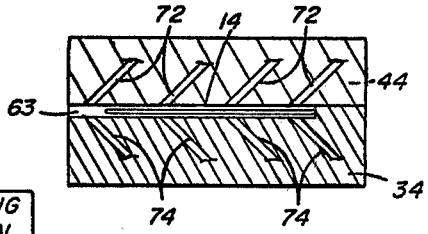
FIG. 7 (sheet 1 of the drawings) is a section view taken substantially along line 7—7 of FIG. 5.
Figure 6:
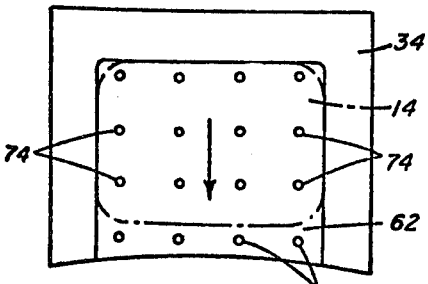
FIG. 6 (sheet 1 of the drawings) is a section view taken substantially along line 6—6 of FIG. 5.
Figure 5:
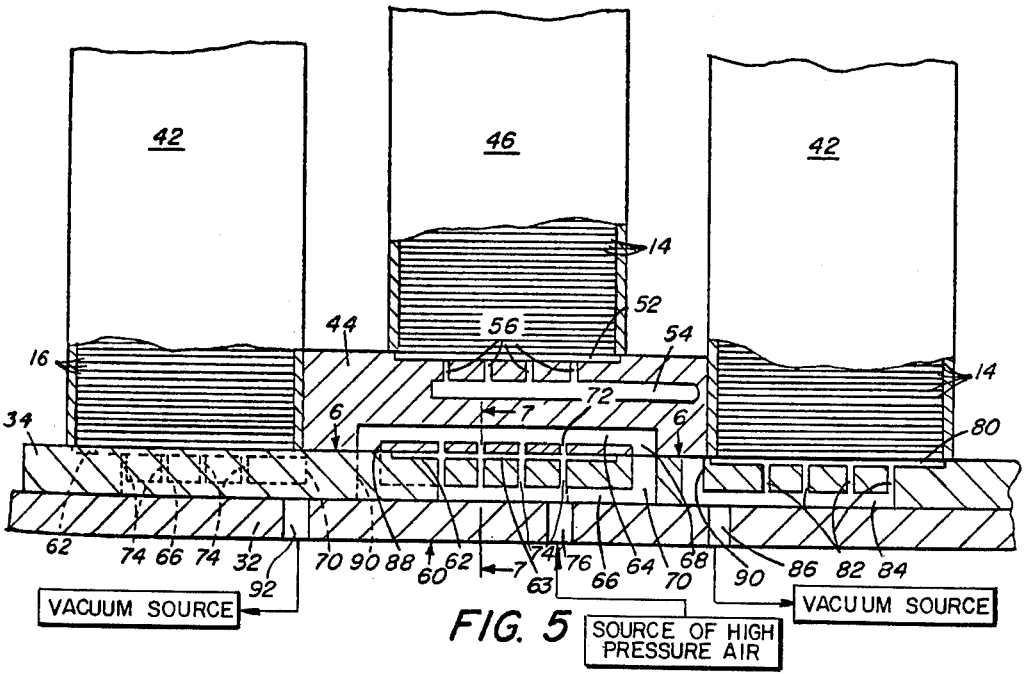
FIG. 5 (sheet 2 of the drawings) is an enlarged view of the apparatus of FIG. 4 illustrating the location of air passages and ports in the apparatus.

The slider member 34 and block 44 cooperate to provide an air gun 60 (FIG. 5) for inserting a card below a stack 11 of packets in a pocket 24 at the card injecting station 26. The air gun 60 comprises a recess 62 in slider member 34 extending to and in alignment with a stack pocket 24 and lying substantially in the same plane as the lowermost packet in the stack. The block 44 closes off the open side of recess 62 to form an enclosed passageway 63 open only at the end facing pocket 24. The block 44 and slider member 34 are provided with conduits 64, 66 respectively which in the position illustrated in FIG. 5 are connected together by aligned ports 68, 70. The block 44 and slider member 34 are further provided with air holes 72, 74 respectively connecting conduits 64, 66 to passageway 63 and arranged at an angle to passageway 63 as illustrated in FIG. 7. Some of the air holes 72, 74 direct air into passageway 63 between the leading end of card 14 in passageway 63 and the pocket, and the remaining air holes 72, 74 direct air into the portion of passageway 63 in which card 14 is located. The conduit 66 in slider member 34 is connected by a port 76 in base 32 to any suitable supply of pressurized air. Accordingly, when the high velocity source of air is connected to conduits 64, 66 by any suitable valve, the jets of air directed into passageway 63 from the leading jets 72, 74 is directed between stack 11 and stack support surface 78 of tray 22 (FIG. 3) for lifting the stack in the pocket and creating a space therebetween. The remaining air jets 72, 74 transport card 14 out of passageway 63 and inject in into the space. After card 14 has been injected under stack 11, slider member 34 is moved to its other position (shown dotted in FIG. 5) causing a card 14 which is held in a recess 80 by vacuum to be moved into alignment with a succeeding card pocket which has been moved to the card inserting station. The vacuum is applied to the card through air holes 82 connecting recess 80 to conduit 84, which is connected by a port 86 to any suitable source of vacuum. In this new position (seen dotted in FIG. 5), conduit 84 is connected to block conduit 64 via ports 88, 90, and conduit 84 is further connected to air supply port 76. Accordingly, when high velocity air is supplied to port 76, the leading air jets 72, 74 lift the stack 11 of packets and insert the card in the space between stack 11 and the stack supporting surface 78. Also, in this new position, recess 62 and air holes 74 are in register with hopper 42 for receiving a printed card 16, and conduit 66 is connected via a port 92 to a source of vacuum for holding printed card 14 in a flat position in recess 62. Accordingly, reciprocal movement of slider member 34 will alternately insert a printed card 16 or an end card 14 under selected stacks 11. During the operation of this card injecting apparatus 30, the air and vacuum ports are connected to the sources of pressurized air and vacuum depending on slider position.

Figure 8:
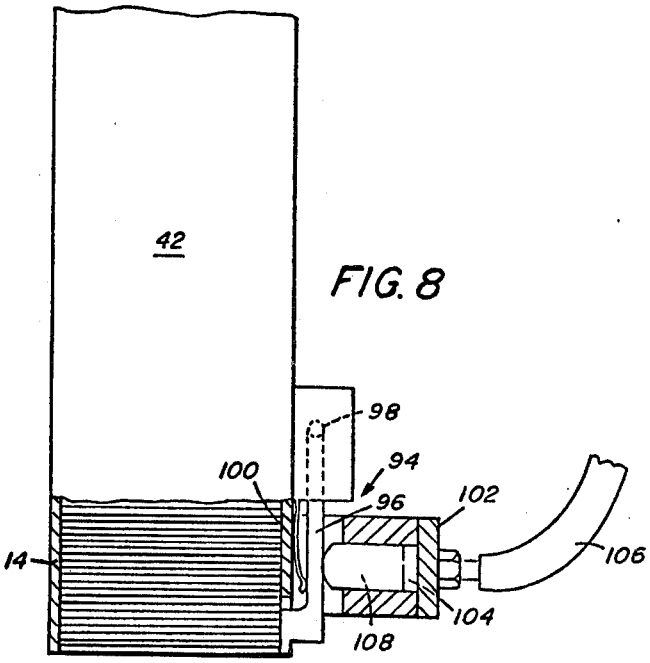
FIG. 8 is a side elevational view, partially in section, of a hopper and illustrating the mechanism for preventing cards from falling out of the bottom of the hopper when it is removed.

In the event of a jam in air gun 60, the carriage 38 can be moved to its retracted position in which hoppers 42, 46 and block 44 are withdrawn from slider member 34 exposing recesses 62, 80 in the slider member. It is also possible to move the middle hopper 46 independently of carriage 38 and hoppers 42 via rails 50 for exposing pusher mechanism 28. In order to prevent cards 14, 16 from dropping out of the ends of hoppers 42, 46 when moved to their retracted positions, each hopper is provided with a clamp mechanism 94 illustrated in FIG. 8 comprising a clamp lever 96 pivotally mounted on pin 98 and normally biased by a spring 100 to an unclamped position. A housing 102 is secured to the hopper having a cylinder 104 connected by a coupling and flexible air line 106 to a supply of pressurized air. A piston 108 is reciprocally mounted in cylinder 104 with the end thereof engaging clamp lever 96. Accordingly, when any hopper 42, 46 is moved to a retracted position, the air supply is connected to cylinder 104 by any suitable valve means causing piston 108 to move clamp lever 96 to is clamped position for clamping the lowermost cards 14 against the opposite side of the hopper, and hence preventing all but one or two of the cards from falling out of the hopper.

The invention has been described in detail with particular reference to preferred embodiments, but it will be understood that variations and modifications can be effected within the spirit and scope of the invention as described.

We claim:

1. In a mechanism for inserting a card under a stack of flat articles, the combination comprising:

a. a pocket having a support surface for supporting a stack of flat articles;

b. means for holding a card adjacent said pocket, said card holding means comprising a stationary member having a flat surface in alignment with said pocket and a movable member slidably supported by said stationary member, said movable member having first and second spaced apart recesses for receiving cards and being selectively movable between a first position in which (1) said first recess is in alignment with said pocket and cooperates with said flat surface to form an enclosed first passageway having a first open end facing said stack and an opposite first closed end and (2) said second recess is in a position to receive a card, and a second position in which (1) said second recess is in alignment with said pocket and cooperates with said flat surface to form an enclosed second passageway having a second open end facing said stack and an opposite second closed end and (2) said first recess is in a position to receive a card;

c. first and second air passages formed by said stationary member and having first and second air passage ends respectively communicating with a selected one of said first and second passageways in said first and second positions respectively of said movable member, one of said first and second air passage ends being positioned adjacent each of said first and second open ends and the other of said first and second air passage ends being positioned between said one of said first and second air passage ends and each of said first and second closed ends, said first and second air passages being inclined relative to a plane in which each of said first and second passageways lie for directing air through each of said first and second open ends toward said pocket support surface; and d. means for supporting air under pressure to said first and second air passages whereby air from said first air passage raises said stack above said pocket support surface, and air from said second air passage transports said card in a selected one of said first and second passageways along said pocket support surface to a position under said raised stack.

2. The card inserting mechanism of claim 1 wherein said movable member forms two sets of third and fourth air passages, each set corresponding to said first and second air passages respectively and having third and fourth air passage ends respectively, one set of said third and fourth air passage ends communicating with said first recess and the other set of said third and fourth air passage ends communicating with said second recess.

3. The card inserting mechanism of claim 2, and further comprising a pair of spaced apart hoppers for receiving cards, and in said first position of said movable member said second recess is below and in register with one of said hoppers for receiving a card therefrom, and in said second position of said movable member said first recess is in register with the other of said hoppers for receiving a card.

* * * * *